US005380053A

United States Patent [19]

Saino

[11] Patent Number: 5,380,053

[45] Date of Patent: Jan. 10, 1995

[54] INTUMESCENT FIRE DOOR LOCK MECHANISM

[75] Inventor: Joseph N. Saino, Memphis, Tenn.

[73] Assignee: F. L. Saino Manufacturing Co., Memphis, Tenn.

[21] Appl. No.: 96,371

[22] Filed: Jul. 26, 1993

[51] Int. Cl.[6] ..... E05C 1/06

[52] U.S. Cl. ..... 292/144; 292/177; 292/DIG. 66

[58] Field of Search ..... 292/144, 177, 179, DIG. 65, 292/DIG. 66; 70/DIG. 10; 49/394, 475.1, 1, 7, 2

[56] References Cited

U.S. PATENT DOCUMENTS

| | | | |
|---|---|---|---|
| 2,518,207 | 8/1950 | Wagner | 292/DIG. 65 X |
| 2,804,159 | 8/1957 | Gavito | 292/177 X |
| 3,664,698 | 5/1972 | Stropkay | 292/DIG. 66 X |
| 4,015,869 | 4/1977 | Horvath | 292/341.16 |
| 4,099,753 | 7/1978 | Gwozdz et al. | 292/177 |
| 4,292,358 | 9/1981 | Fryer et al. | 428/135 |
| 4,539,929 | 9/1985 | Sestak et al. | 292/DIG. 66 X |
| 4,714,285 | 12/1987 | Langham | 292/163 |
| 5,121,950 | 6/1992 | Davidian | 292/164 |

FOREIGN PATENT DOCUMENTS

| | | | |
|---|---|---|---|
| 555760 | 3/1923 | France | 292/144 |

*Primary Examiner*—Rodney M. Lindsey
*Attorney, Agent, or Firm*—Walker, McKenzie & Walker

[57] ABSTRACT

A lock mechanism including a latch assembly for being attached to a movable door member and for movement between an extended position in which the movable door member is locked in a closed position and a retracted position in which the movable door member is allowed to move between opened and closed positions. A holding assembly is included for normally holding the latch assembly in the retracted position. Intumescent material is included for forcing the latch assembly to the extended position if subjected to heat above a certain temperature.

7 Claims, 2 Drawing Sheets

INTUMESCENT FIRE DOOR LOCK MECHANISM

BACKGROUND OF THE INVENTION

1. Field of the Invention

The present invention relates, in general, to fire doors and, more specifically, to an intumescent fire door lock mechanism for locking the edges of a fire door to an adjacent door edge or door frame, etc., in the event of a fire or the like, thereby preventing the edges of the door from bowing away from the adjacent door edge or door frame, etc.

2. Description of the Related Art

A preliminary patentability search has been conducted in Class 52, subclass 232, and Class 292, Digest 66.

Horvath, U.S. Pat. No. 4,015,869, issued Apr. 5, 1977, discloses a catch mechanism for installation in a door frame to cooperate with a door lock on a fire door. The mechanism includes a catch member pivotable between an operative position for serving as a door catch and an inoperative position to enable release of the door no matter what the condition of the door lock. The mechanism includes a heat responsive locking device which locks the catch member in its catch position in the event of a fire generating high temperatures. The locking device may comprise a biased locking plunger mounted in a cavity within the catch member and normally held in a retracted position by a heat fusible metal plug but extendible on melting of the plug to engage the catch body and so lock the catch member.

Gwozdz et al., U.S. Pat. No. 4,099,753, issued Jul. 11, 1978, discloses a lock housing adapted to be mounted at the free vertical edge of the inactive one of a pair of hinged doors that have adjacent vertical edges when both doors are closed. Slidably mounted in the housing is an axially movable shaft that extends vertically therefrom and has a normally retracted latch bolt mounted on its outer end. Operatively connected to the opposite end of the shaft is the inner end of a rocker arm, the central part of which is pivotally connected to the housing on a horizontal axis. A cam pivotally connected on a vertical axis to the housing normally projects from it for engagement by the free vertical edge of the active door for swinging the cam into the housing to swing the rocker arm vertically in order to project the latch bolt from a horizontal edge of the inactive door. The rocker arm is so mounted in the housing that it will be moved by the cam bodily away from the free edge of the door if the shaft cannot move, whereby the mechanism will not be damaged.

Fryer et al., U.S. Pat. No. 4,292,358, issued Sep. 29, 1981, discloses a heat resistant protective barrier having one or more layers each comprising a support medium in the form of a plurality of closely spaced-apart strands and a heat actuated and resistive intumescent coating on the strands. The support medium preferably comprises an expanded metal mesh.

Langham, U.S. Pat. No. 4,714,285, issued Dec. 22, 1987, discloses a fire-break door including a swivelling leaf provided with at least one lock with a drawbolt which can be controlled by an operating member. The leaf cooperates with a door-closure to allow the leaf to swing back automatically to the closed position thereof. Means are provided on the one hand to retain the lock bolt in a recessed or withdrawn position when the door leaf lies in a closed position, and on the other hand to let the bolt be released and enter the keeper of the lock with an abnormal rise in the temperature adjacent the door.

Davidian, U.S. Pat. No. 5,121,950, issued Jun. 16, 1992, discloses a fire-retardant pivoted door assembly having fire activated latching members. The door assembly includes a metal door frame having jambs and a header in which a fire-retardant door is mounted by a hinge assembly with a lower temperature resistance than the door and frame. Fire actuated latch bolt assemblies in the door are spaced vertically along the hinge side of the door, and include a housing providing an elongated cavity opening at the edge of the door. A latch bolt is slidably seated in the cavity and is biased towards the opening of the cavity. A fusible closure extends across the opening of the cavity and retains the latch bolt against the biasing pressure. The hinge jamb has a spaced recess formed therein to receive the latch bolt upon melting of the fusible closure.

The above identified patents do not disclose or suggest the present invention. While both Langham, U.S. Pat. No. 4,714,285, and Davidian, U.S. Pat. No. 5,121,950, disclose fire door locks including plungers which normally sit in a non-extended position in a door leaf and which move to an extended position in an adjacent door frame in the event of a fire, neither of these patents disclose or suggest such fire door locks that use springs to hold the bolts or plungers in the retracted or non-extended positions and intumescent material to move the bolts or plungers to the extended position in the event of a fire or the like.

SUMMARY OF THE INVENTION

The present invention is directed toward providing an improved lock for fire doors and the like. The concept of the present invention is to combine a plunger-type lock with a spring for normally holding the plunger in a retracted position and with intumescent material for forcing the plunger to an extended position in the event of a fire or the like.

The lock mechanism of the present invention is designed for use with a typical fire door. Upper and lower lock mechanisms may attached to the opening edge of the fire door. The preferred embodiment of the lock mechanism of the present invention includes a plunger slidably mounted with a barrel. A spring is provided to normally hold the plunger in a retracted, unlocked position. Intumescent material is positioned within a cup which is used to close off one end of the barrel. The head of the plunger closes off the barrel on the other side of the intumescent material. A sleeve is mounted to the barrel for slidably guiding the rod of the plunger. A plate is used to mount the lock mechanism to the edge of the fire door.

In normal, day-to-day use, the lock mechanism just sits in the unextended position on the fire door. Under fire conditions, the intumescent material will expand due to heat and force the plunger to an extended position with the distal end of the rod extending into the adjacent door edge or door frame, etc., thereby preventing the fire door from bowing away from the adjacent door edge or door frame, etc.

DESCRIPTION OF THE PREFERRED EMBODIMENT

Figure 1:
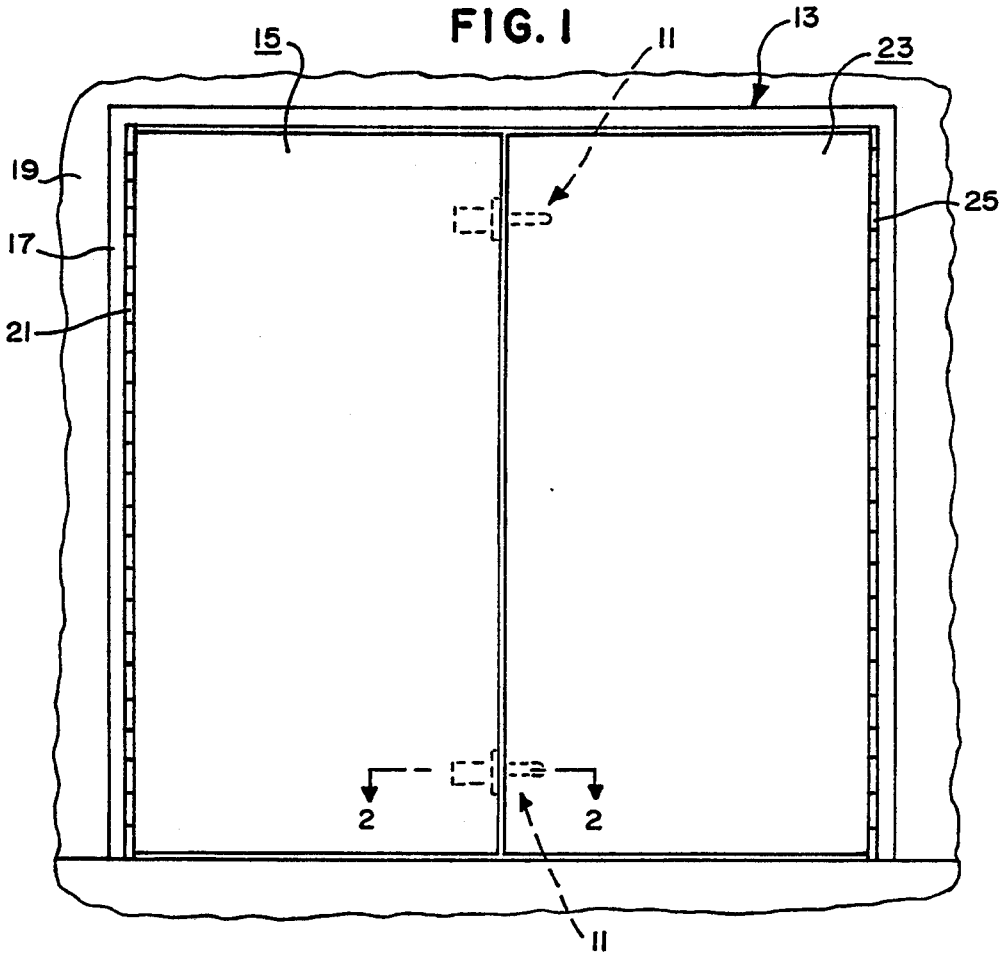
FIG. 1 is a front elevational view of a door assembly with a pair of the lock mechanisms of the present invention combined therewith.

The preferred embodiment of the lock mechanism of the present invention is shown in FIGS. 1-4 and identified by the numeral 11. The lock mechanism 11 is for use with a door assembly 13 including at least one door member movable between an opened position and a closed position. It should be noted that while two lock mechanisms 11 of the present invention are shown in FIG. 1 in combination with the door assembly 13, with one lock mechanism 11 located substantially adjacent the top of the door assembly 13 and with the other lock mechanism 11 located substantially adjacent the bottom of the door assembly 13, the preferred embodiment of the present invention is not limited thereto.

Figure 2:
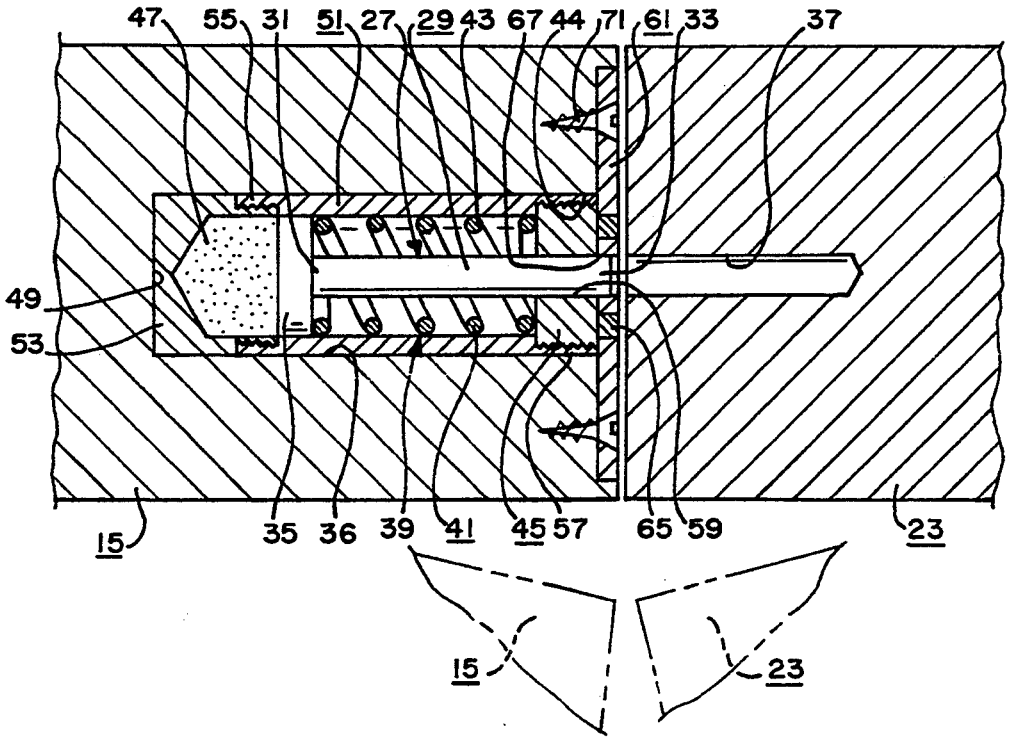
FIG. 2 is an enlarged sectional view substantially as taken on line 2—2 of FIG. 1 with the lock mechanism of the present invention shown in a retracted or unlocked position.
Figure 3:
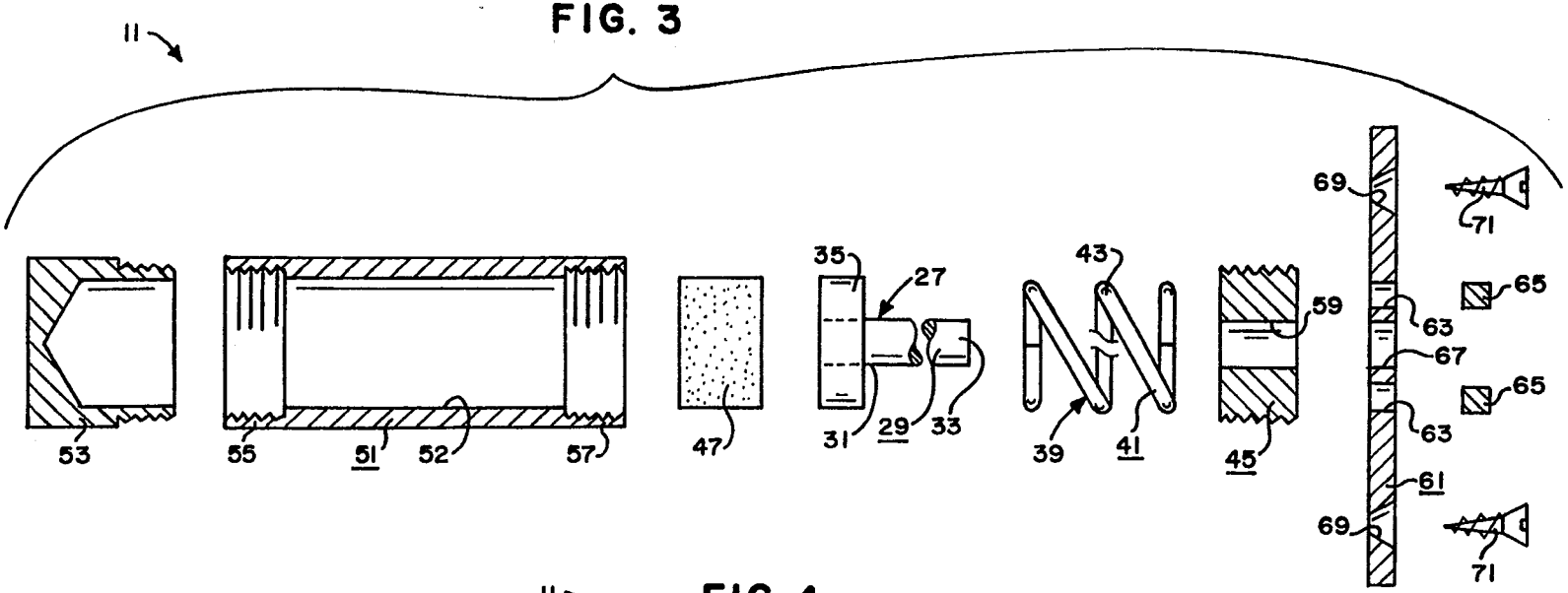
FIG. 3 is an exploded sectional view of the lock mechanism of the present invention with portions thereof broken away for clarity.
Figure 4:
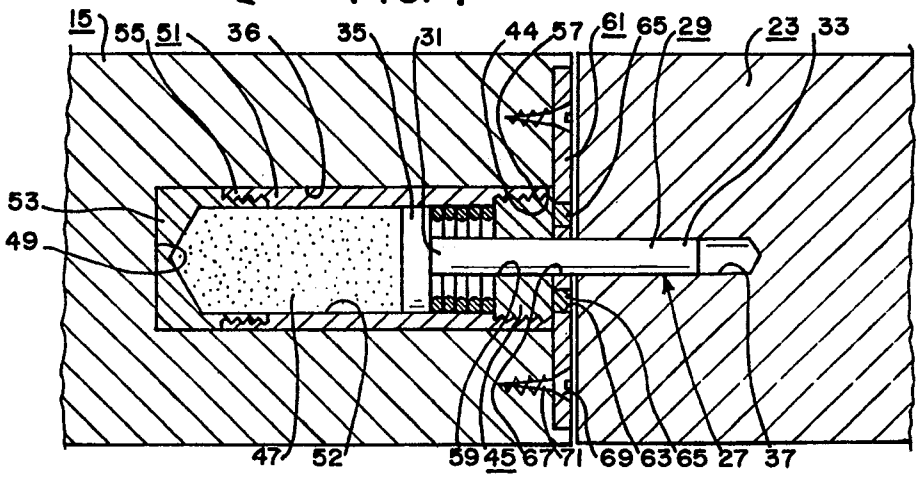
FIG. 4 s a sectional view substantially similar to FIG. 2 but with the lock mechanism of the present invention shown in an extended or locked position.

The door assembly 13 shown in FIG. 1 includes a first door member 15 hingeably attached to a jamb assembly 17 adjacent one side of a door opening through a wall 19 by way of first hinge means 21 for movement between a closed position as shown in solid lines in FIGS. 1, 2 and 4 and an opened position as shown in broken lines in FIG. 2, and a second door member 23 hingeably attached to the jamb assembly 17 adjacent the other side of the door opening through the wall 19 by way of a second hinge means 25 from movement between a closed position as shown in solid lines in FIGS. 1, 2 and 4 and an opened position as shown in broken lines in FIG. 2. Thus, as clearly shown in FIGS. 2 and 4, the free edges of the door members 15, 23 (i.e., the normally vertical edges thereof opposite the respective hinge means 21, 25) are generally adjacent one another when both door members 15, 23 are in the closed position. However, it should be noted that the lock mechanism 11 of the present invention is not limited to such door assemblies and can be used with door assemblies including a pair of sliding doors, a single hinged door, bifolding doors, etc.

The lock mechanism 11 includes latch means 27 for being attached relative to the door assembly 13 and for movement between a retracted position as shown in FIG. 2 and an extended position as shown in FIG. 4.

The latch means 27 is designed so that the movable door member or members of a door assembly will be locked in a closed position when the latch means 27 is in the extended position and will be allowed to move between the opened and closed positions when the latch means 27 is in the retracted position. The latch means 27 preferably includes a plunger or rod member 29 having a first end 31 and a second end 33, and an enlarged head 35 for being attached to the first end 31 of the rod member 29.

In the preferred embodiment of the lock mechanism 11 as shown in FIGS. 2 and 4, the rod member 29 and the head 35 of the plunger or rod member 29 of the latch means 27 are preferably slidably mounted within a cavity 36 in the first door member 15 in such a manner that when the first and second door members 15, 23 are in the closed positions and the latch means 27 is in the extended position, the second end 33 of the rod member 29 will extend into a cavity 37 in the second door member 23 with the first end 31 of the rod member 29 and the head 35 remaining within the cavity 36 in the first door member 15 as clearly shown in FIG. 4 to thereby securely lock the door members 15, 23 in the closed positions as will now be apparent to those skilled in the art.

The lock mechanism 11 includes holding means 39 for normally holding the latch means 27 in the retracted position. The holding means 39 may include a spring means 41 for normally urging the latch means 27 to the retracted position. For example, the spring means 41 may consist of a typical coil spring 43 for being positioned around the first end 31 of the rod member 29 of the latch means 27. In the preferred embodiment of the lock mechanism 11 as shown in FIGS. 2 and 4, the coil spring 43 is positioned within the cavity 36 in the first door member 15 between the mouth 44 of the cavity 36 and the enlarged head 35 of the latch means 27 around the first end 31 of the rod member 29 of the latch means 27 as clearly shown in FIGS. 2 and 4 for acting against the enlarged head 35 to urge rod member 29 to the retracted position.

A stop means 45 or the like is preferably provided adjacent the mouth 44 of the cavity 36 for entrapping the spring means 41 against the enlarged head 35 of the latch means 27 (i.e., between the stop means 45 and the enlarged head 35) and for causing the force of the spring means 41 to act against the enlarged head 35 to normally urge the rod member 29 to the retracted position as will now be apparent to those skilled in the art.

The lock mechanism 11 includes intumescent means 47 for forcing the latch means 27 to the extended position if subjected to heat above a certain temperature. The intumescent means 47 may consist of any well-known material that will swell when subjected to heat above a certain temperature such as an intumescent material supplied by Lorient Polyproducts Ltd., Fairfax Road, Heathfield Industrial Estate, Newton Abbot, Devon TQ12 6UD England.

In the preferred embodiment of the lock mechanism 11 as shown in FIGS. 2 and 4, the intumescent means 47 is preferably positioned within the cavity 36 in the first door member 15 between the end 49 of the cavity 36 and the enlarged head 35 of the latch means 27. Thus, spring means 41 will normally force the enlarged head 35 of the latch means 27 against the intumescent means 47 and force the intumescent means 47 against the end 49 of the cavity 36 as shown in FIG. 2. However, when the intumescent means 47 is subjected to heat above a certain temperature such as, for example, in the event of a fire adjacent the door assembly 13, the intumescent means 47 will swell, overcome the force of the spring means 41, and urge or force the latch means 27 to the extended position as shown in FIG. 4 to thereby lock the door members 15, 23 in the closed position as will now be apparent to those skilled in the art.

The lock mechanism 13 preferably includes a rigid, hollow barrel 51 constructed of metal or the like for forming or defining the cavity 36. In the preferred embodiment of the lock mechanism 13 shown in FIGS. 2 and 4, the barrel 51 is preferably mounted within and lines the cavity 36 in the first door member 15. The barrel 51 thus has a cavity 52 therethrough for slidably receiving the latch means 27 and holding the intumescent means 47 as clearly shown in FIGS. 2 and 4.

The lock mechanism 13 preferably includes a cap or cup member 53 for being attached to the first end 55 of the barrel 51 to close the first end 55 of the barrel 51. More specifically, the cup member 53 and the first end 55 of the barrel 51 may be screwably attached to one another to allow the cup member 53 to be screwed onto the first end 55 of the barrel 51 as shown in FIGS. 2 and 4.

The stop means 45 may consist of a metal sleeve or the like for being screwably attached to the second end 57 of the barrel 51 to substantially close the second end 57 of the barrel 51 as shown in FIGS. 2 and 4. The stop means 45 preferably has a central aperture 59 therethrough for allowing the rod member 29 of the latch means 25 to slide sack and forth therein between the extended and retracted positions.

The lock mechanism 11 preferably includes a plate member 61 for allowing the lock mechanism 11 to be easily attached to the edge of a door member. The plate member 61 is preferably fixedly attached to the stop means 45 as by being welded thereto. Thus, for example, the plate member 61 may have a pair of apertures 63 therethrough to allow plug welds 65 to be formed between the plate member 61 and the stop means 45 as will now be apparent to those skilled in the art. The second end 57 of the barrel 51 can, in turn, be screwed or otherwise attached to the stop means 45 whereby the rest of the lock mechanism 11 can be attached to the plate member 61 as will now be apparent to those skilled in the art.

In addition, the plate member 61 preferably has a central aperture 67 therethrough for allowing the rod member 29 to slide back and forth therein between the extended and retracted positions. The plate member 61 may also have a pair of apertures 69 therethrough for allowing screws 71 to pass therethrough to attach the plate member 61 and, thus, the rest of the lock mechanism 11, to the edge of the first door member 15, etc.

Although the present invention has been described and illustrated with respect to a preferred embodiment and a preferred use wherefor, it is not to be so limited since modifications and changes can be made therein which are within the full intended scope of the invention.

I claim:

1. A lock mechanism for a door assembly including at least one movable door member for movement between an opened position and a closed position; said lock mechanism comprising:

a) latch means coupled to the movable door member for movement between an extended position in which the movable door member is locked in the closed position and a retracted position in which the movable door member is allowed to move between the opened and closed positions;

b) holding means for normally holding said latch means in said retracted position; and c) intumescent means for forcing said latch means to said extended position in the event of a fire adjacent the door assembly.

2. The lock mechanism of claim 1 in which said door member has a cavity therein, said cavity having a closed end and an opened end; and in which said latch means has a first end and a second end, said first end of said latch means is slidably positioned within said cavity of said door member, said intumescent means is positioned within said cavity of said door member between said first end of said latch means and said closed end of said cavity of said door member.

3. The lock mechanism of claim 2 in which said holding means includes spring means for urging said first end of said latch means toward said closed end of said cavity of said door member.

4. The lock mechanism of claim 3 in which is included a barrel for lining said cavity of said door member, said barrel having a cavity for slidably receiving said latch means; said cavity of said barrel having opened first and second ends; and in which is included a cap attached to said first end of said cavity of said barrel for closing said first end of said cavity of said barrel.

5. The lock mechanism of claim 4 in which said latch means includes an elongated rod member having a first end and a second end; and in which said latch means includes a head member attached to said first end of said rod member for closely fitting within said cavity of said barrel.

6. The lock mechanism of claim 5 in which is included a sleeve member attached to said barrel adjacent said second end of said cavity of said barrel, said sleeve member having an aperture thereof for allowing said rod member to slide therethrough, said head member of said latch means being larger than said aperture of said sleeve member, said spring means positioned between said sleeve member and said head member whereby said spring means is entrapped between said sleeve member and said head member to normally urge said head member and said rod member to a retracted position.

7. The combination with a fire door assembly including a first fire door having a first edge and a second fire door having a first edge, of a fire door lock mechanism for locking the first edge of the first fire door and the first edge of the second fire door together in the event of a fire adjacent the first and second fire doors to prevent the first edges of the first and second fire doors from bowing away from one another in the event of a fire adjacent the first and second fire doors; the first edge of the first fire door having a cavity therein; the first edge of the second fire door having a cavity therein; said fire door lock mechanism comprising:

a) latch means slidably positioned within the cavity in the first edge of the first fire door for movement between an extended position in which the first and second fire doors are locked in a closed position and a retracted position in which the first and second fire doors are allowed to move between opened and closed positions; said latch means having a first end and a second end, said second end extending into the cavity in the first edge of the second fire door when the first and second fire doors are closed and the latch means is in said extended position;

b) holding means for normally holding said latch means in said retracted position; and c) intumescent means for swelling in the event of a fire adjacent the first and second fire doors to force said latch means to said extended position.

* * * * *